US008692658B2

(12) United States Patent
Brown et al.

(10) Patent No.: US 8,692,658 B2
(45) Date of Patent: Apr. 8, 2014

(54) INTERACTIVE TIMING SYSTEM FOR A PLAY SYSTEM

(75) Inventors: Patrick W. Brown, Auburn, OH (US); John R. Nottingham, Bratenahl, OH (US); John W. Spirk, Gates Mills, OH (US); Robert F. Soreo, Cleveland Heights, OH (US)

(73) Assignee: Backyard Leisure Holdings, Inc., Pittsburg, KS (US)

( * ) Notice: Subject to any disclaimer, the term of this patent is extended or adjusted under 35 U.S.C. 154(b) by 399 days.

(21) Appl. No.: 13/092,270

(22) Filed: Apr. 22, 2011

(65) Prior Publication Data

US 2011/0260841 A1 Oct. 27, 2011

Related U.S. Application Data

(60) Provisional application No. 61/326,873, filed on Apr. 22, 2010.

(51) Int. Cl.
*G07C 1/24* (2006.01)

(52) U.S. Cl.
USPC ..... 340/323 R; 340/309.5; 340/691.6; 340/692

(58) Field of Classification Search
USPC ..... 340/323 R, 309.16, 309.3, 309.4, 309.5; 472/116, 118
See application file for complete search history.

(56) References Cited

U.S. PATENT DOCUMENTS

| | | | | |
|---|---|---|---|---|
| 6,364,315 | B1 * | 4/2002 | Velke, III | 273/454 |
| 2004/0077423 | A1 * | 4/2004 | Weston et al. | 472/137 |
| 2006/0046234 | A1 * | 3/2006 | Sperry | 434/255 |
| 2009/0197740 | A1 | 8/2009 | Julskjaer et al. | |

FOREIGN PATENT DOCUMENTS

| | | | |
|---|---|---|---|
| KR | 200320924 | Y1 | 7/2003 |
| KR | 1020080023000 | A | 3/2008 |

OTHER PUBLICATIONS

PCT Search Report and Written Opinion from PCT Application No. PCT/US2011/033535 entitled Interactive Timing System for a Play System (Dated Jan. 4, 2012).

* cited by examiner

*Primary Examiner* — Thomas Mullen
(74) *Attorney, Agent, or Firm* — Hovey Williams LLP

(57) ABSTRACT

An interactive timing system for use with a play system includes a base unit configured for mounting at a base location on the play system and a plurality of remote units each configured for mounting at a location on the play system remote from the base station. The base unit comprises a timer and a switch for activating the timer. Each remote unit comprises an indicator and a manually-activated input for controlling the indicator.

20 Claims, 7 Drawing Sheets

INTERACTIVE TIMING SYSTEM FOR A PLAY SYSTEM

RELATED APPLICATIONS

The present application claims the priority benefit of U.S. Provisional Patent Application Ser. No. 61/326,873 entitled "STRUCTURE WITH SOUNDS AND TIMER," filed Apr. 22, 2010, the entire disclosure of which is incorporated herein by reference.

BACKGROUND

Swing sets, obstacle courses, and other play systems typically include a number of play accessories such as slides, climbing walls, swings, etc. and/or a number of "stations" such as walls, hurdles, ladders, etc. The play accessories and/or stations are typically spaced-apart so that a child may play on or otherwise interact with them one at a time. For example, an obstacle course may have spaced-apart walls, monkey bars, and rope swings that can be successively climbed, traversed, and swung across, respectively, to complete the course.

SUMMARY

Applicant has discovered that children's enjoyment of swing sets, obstacle courses and other play systems is enhanced when they receive feedback of their interaction with the play accessories or stations. Embodiments of the present invention take advantage of this discovery by providing an interactive timing system that provides feedback to children as they interact with a play system's accessories or stations.

An embodiment of the interactive timing system broadly comprises a base unit configured for mounting at a base location on or near a play system and a plurality of remote units configured for mounting at locations spaced from the base unit. For example, the base unit may be mounted at a starting point of an obstacle course or swing set and the remote units may each be mounted on or near stations of the obstacle course or accessories of the swing set.

In one embodiment, the base unit comprises a timer and a pushbutton switch or other manually-activated input for activating the timer. Each remote unit comprises an indicator such as a sound-emitting device or light and a pushbutton switch or other manually-activated input for controlling its indicator. In use, a child may press the switch on the base unit to start the timer and may then run to each remote unit and press its switch. As the switch of each remote unit is pressed, its indicator emits a sound or light so the child and observers receive feedback that the station or play accessory associated with the remote unit has been reached and/or completed. Once the child has pressed the switches on all the remote units, the child may return to the base unit and again press its switch to stop the timer to receive an indication of the time it took to complete the entire obstacle course or interact with the accessories of the swing set.

In another embodiment, the base unit and remote units may communicate with one another so that a user may create a custom obstacle course or similar challenge. Specifically, the base unit may comprise a transmitter for transmitting an activation signal to the remote units when its switch is pressed, and each remote unit may comprise a receiver for receiving the activation signal and for controlling activation of its indicator in response thereto. The base unit may further comprise a control device configured to instruct the timer to countdown a user-specified amount of time when its switch is pressed. The control device may also instruct each of the remote units to activate its indicator in a particular user-selected sequence when the base unit switch is pressed. Each of the remote units may also comprise a control device configured to send a confirmation signal to the control device of the base unit when its switch is pressed.

In use, a child may press the switch of the base unit to start the timer. The base unit then sends an activation signal to a first one of the remote units to trigger its indicator. The child then runs to the first remote unit and presses its switch. This turns off or silences the first remote unit's indicator and triggers the base unit or the first remote unit to send an activation signal to a second remote unit to trigger its indicator. The child then runs from the first remote unit to the second remote unit and presses the switch of the second remote unit to turn off or silence its indicator. This process is repeated until all of the remote units have been activated and then turned off by the child. After the last remote unit is reached by the child and turned off or silenced, an indicator on the base unit may illuminate or make sounds to prompt the child to return to the base unit. When the child presses the switch on the base unit, the timer indicates the time it took for the child to reach all of the remote units.

The base unit and/or one or more of the remote units may also comprise an input for receiving audio signals from an MP3 player or other external audio source. The base unit and/or the remote units may also comprise memory for storing a plurality of audio files and a selector switch for permitting a user to select which of the audio files is reproduced by the sound-emitting device.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
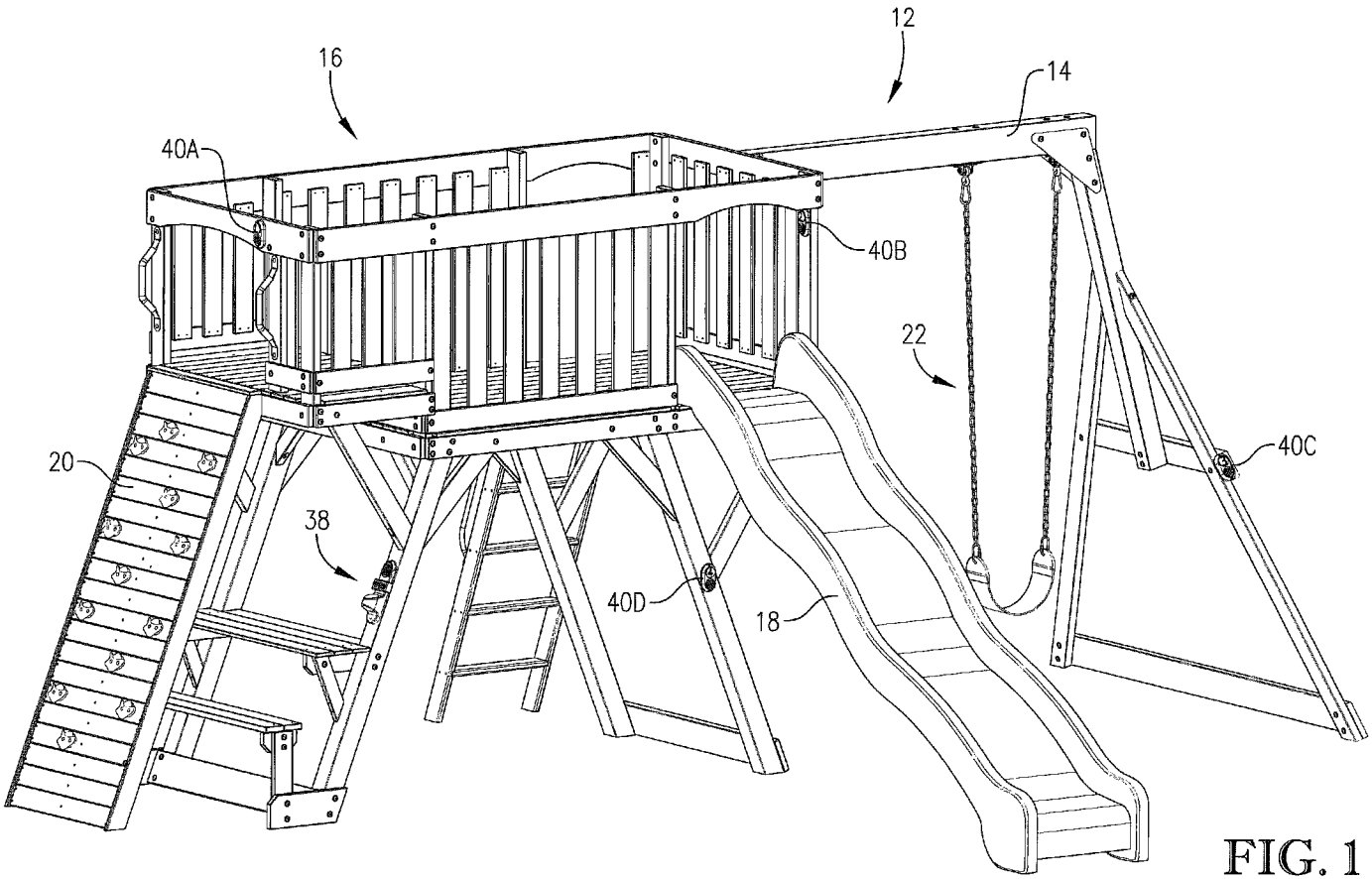
FIG. 1 is a perspective view of an interactive timing system constructed in accordance with an embodiment of the invention shown attached to an exemplary play system.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
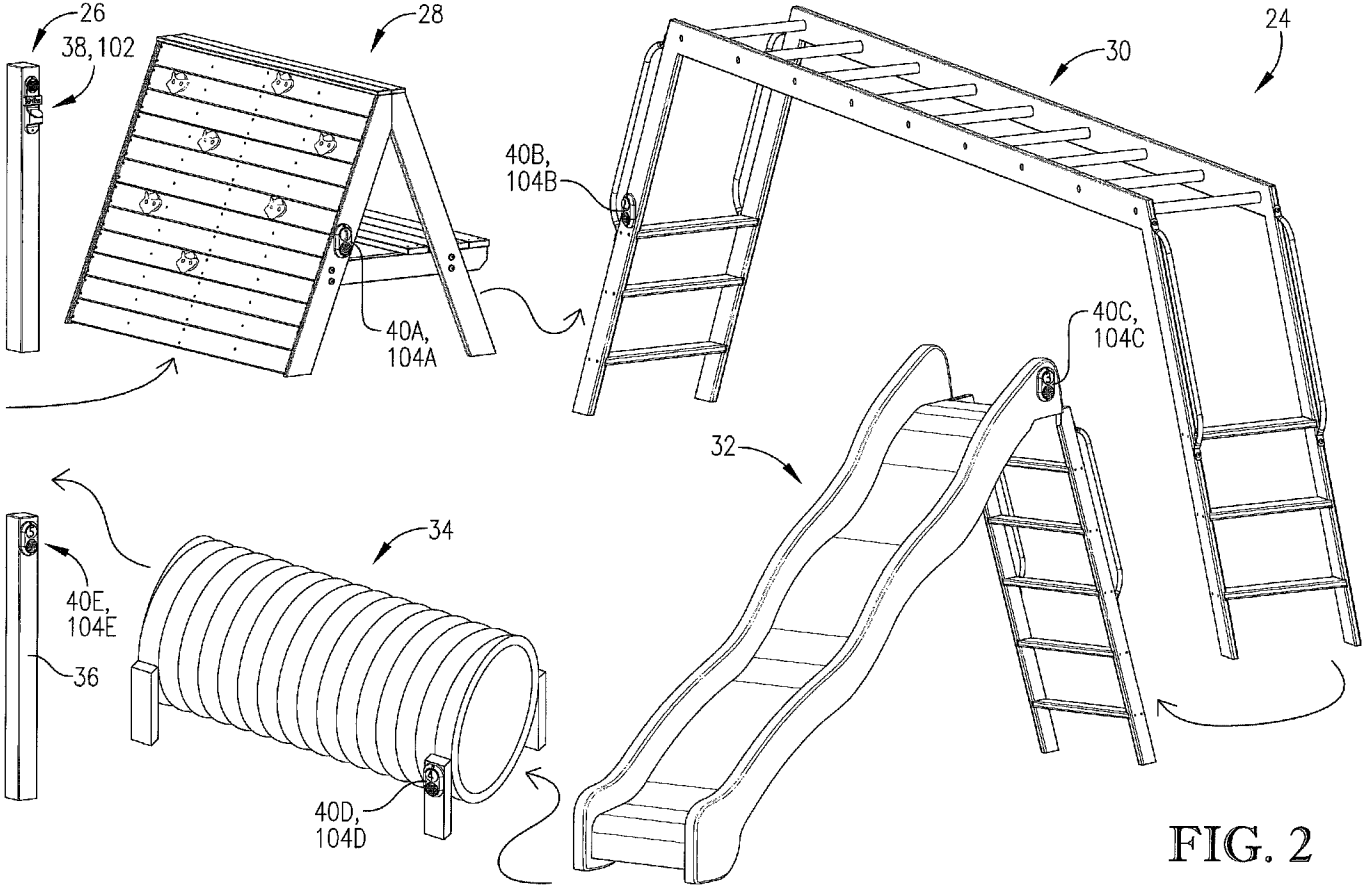
FIG. 2 is a perspective view of the interactive timing system shown attached to another exemplary play system.

Turning now to the drawing figures, an interactive timing system broadly referred to by the numeral 10 and constructed in accordance with various embodiments of the invention is illustrated. As illustrated in FIG. 1, components of the system 10 may be mounted on or near a swing set 12 or other play structure having a frame or other support 14 and a number of accessories such as an elevated fort or deck 16, a slide 18, a climbing wall 20, and/or a number of swings 22. Similarly, as illustrated in FIG. 2, components of the system 10 may be mounted on or near an obstacle course 24 having a number of stations such as a base or home station 26, a climbing wall 28, a set of monkey bars 30, a slide 32, a tunnel 34, and/or a finish marker 36. FIGS. 1 and 2 illustrate but two examples of play systems, accessories, and stations on which the interactive timing system 10 may be used. Other play systems and similar structures may be substituted without departing from the scope of the invention.

Figure 4:
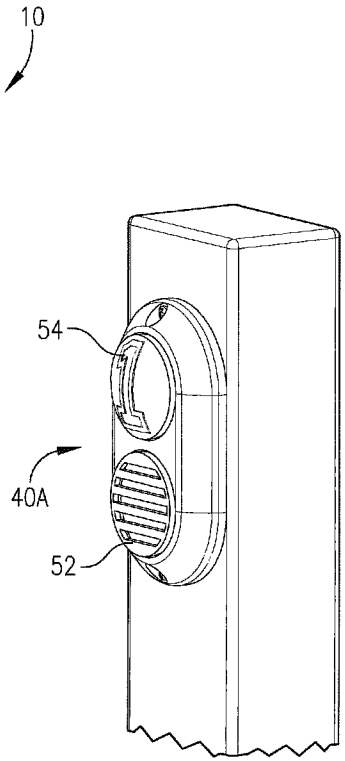
FIG. 4 is an enlarged perspective view of one of the remote units of the interactive timing system.
Figure 3:
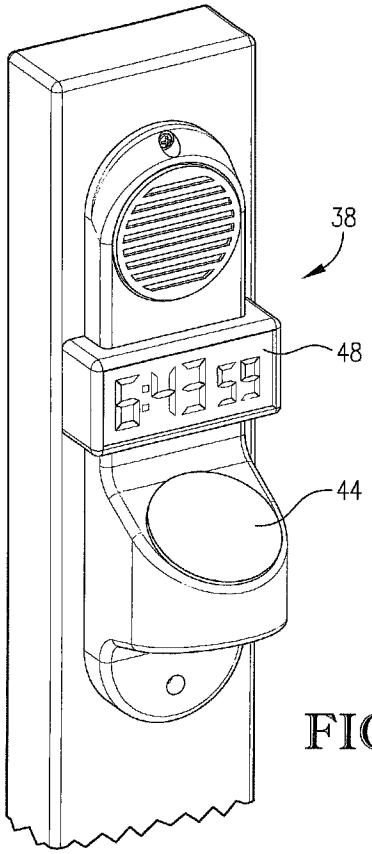
FIG. 3 is an enlarged perspective view of the base unit of the interactive timing system.

An embodiment of the interactive timing system 10 is best illustrated in FIGS. 3 and 4 and broadly comprises a base unit 38 and a plurality of remote units 40A-E. The base unit 38 may be mounted to a frame or support of the play structure as illustrated in FIG. 1 or to the base or home station 26 of the obstacle source as illustrated in FIG. 2. Similarly, the remote units 40A-E may be mounted on or near the accessories of the swing set as illustrated in FIG. 1 or on or near the stations of the obstacle course as illustrated in FIG. 2. FIGS. 1 and 2 show one base unit 38 and four or five remote units 40A-E for each play system 12, 24, but any number of base units and/or remote units may be provided with each play system without departing from the scope of the present invention.

Figure 5:
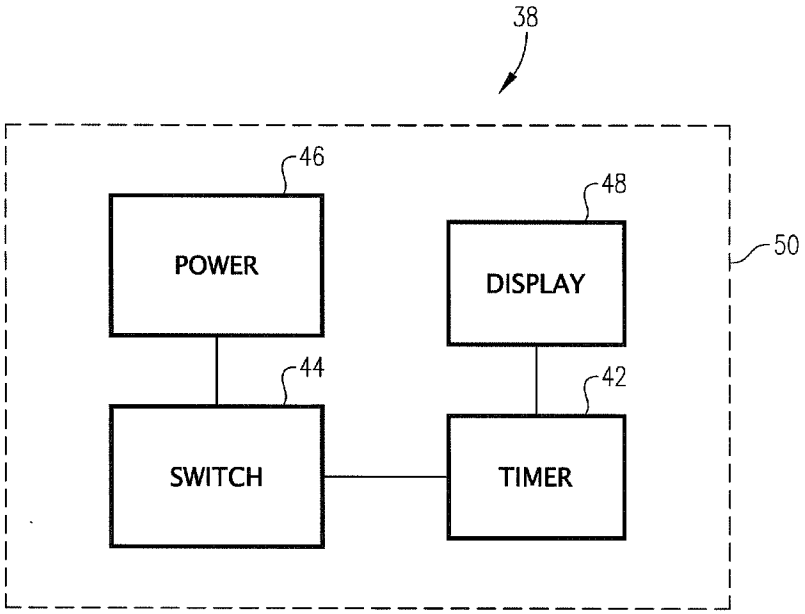
FIG. 5 is a block diagram of the primary components of a base unit constructed in accordance with an embodiment of the invention.

An embodiment of the base unit 38 is illustrated in FIG. 5 and broadly comprises a timer 42, a switch or other manually-activated input 44, and a power source 46. Other embodiments of the base unit 38 are described below.

The timer 42 may include any conventional electronic timing circuitry and a display 48 for displaying an elapsed time or a countdown time once the switch is operated 44. For example, the timer 42 may countdown and display 1 minute, 2 minutes, 5 minutes, etc. once the switch is operated or may simply display an elapsed time.

The switch 44 is provided for controlling the timer 42 and may be a push button switch, toggle switch, rocker switch, or any other device that can be easily operated by a child. As described below, the switch activates the timer to begin a countdown or elapsed time when it is first pressed and then stops the countdown or elapsed time when it is pressed again. The switch may clear the timer when it is pressed a third time.

The power source 46 powers the timer and may include one or more batteries, a solar cell, an electrical terminal or contact for receiving power from an electricity source, or any other conventional power supply.

The components of the base unit 38 are preferably housed within a water proof or water resistant enclosure 50 made of plastic or other suitable materials. Gaskets, O-rings, or other seals may be positioned around the powered components of the base unit to resist migration of water into the enclosure. In other embodiments, the components of the base unit may be integrally formed with an accessory of a play structure or station of an obstacle course so that a separate enclosure isn't needed.

Figure 7:
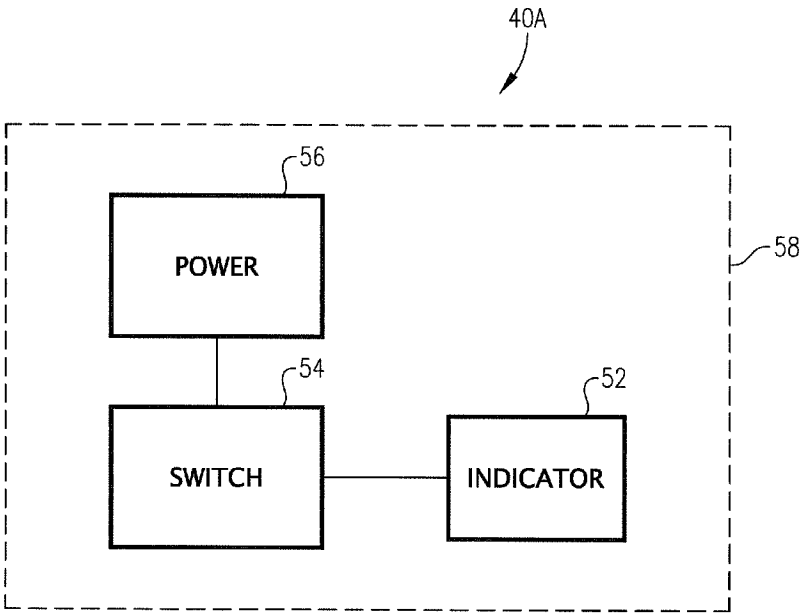
FIG. 7 is a block diagram of the primary components of a remote unit constructed in accordance with an embodiment of the invention.

An embodiment of one of the remote units 40A is illustrated in FIG. 7 and comprises an indicator 52, a switch or other manually-activated input 54, and a power source 56. Other embodiments of the remote units are described below.

The indicator 52 may be any device that indicates that its remote unit has been activated. For example, the indicator 52 may be a sound-emitting device that reproduces sounds when activated by its switch 54. The sound-emitting device may include a speaker diaphragm that is driven by a voice coil and magnet assembly and may have internal amplifiers and other driver circuitry. The sound-emitting device may also be coupled with a conventional volume control switch to permit volume adjustment. In some embodiments, each remote unit emits a unique sound so that a child may trigger a variety of different sounds while using the system. The sounds may include ringing sounds, horn sounds, music, voices, etc.

The indicator 52 may also comprise one or more LEDs or other lights that are illuminated when activated by their switch 54. Multi-colored LEDs and a selector switch may also be provided so that a user may choose the color, or colors, emitted by the LEDs.

Not all of the remote units 40A-E must contain an indicator 52. Instead, some of the remote units may only comprise a switch 54 that is coupled with a central indicator. When a child operates one of the switches as described below, a signal is sent to the central indicator to emit a sound or light. The central indicator may be a stand-alone device or may be incorporated into one of the remote units. In other words, some of the remote units may only have a switch whereas others may have a switch and an indicator that acts as a central indicator for multiple remote units.

The switch 54 is provided for turning on or otherwise controlling its indicator 52 when pressed and may be a push button switch, toggle switch, rocker switch, or any other device that can be easily operated by a child.

The power source 56 powers the indicator 52 and may include one or more batteries, a solar cell, an electrical terminal or contact for receiving power from an electricity source, or any other conventional power supply.

As with the base unit 38, the components of each remote unit 40A-E are housed within a water proof or water resistant enclosure 58 made of plastic or other suitable materials. Gaskets, O-rings, or other seals may be provided to resist migration of water into the enclosure. In other embodiments, the components of the remote units may be integrally formed with accessories or stations of the play systems so that separate enclosures aren't needed.

The above-described embodiment of the interactive timing system 10 operates as follows. A child first presses the switch 44 on the base unit 38 to start the timer 42 when he or she is ready to start the obstacle course or start playing on the swing set. The child then successively runs to each of the remote units 40A-E and pressed its switch 54. As the switch of each remote unit is pressed, its indicator 52 is activated so the child and observers receive feedback that the play system accessory or station has been reached and/or completed. Once the child has pressed the switches 54 on all the remote units, the child may return to the base unit 38 and again press its switch to stop the timer to receive an indication of the time it took to use each accessory or complete the entire obstacle course. The indicators 52 on the remote units may turn off automatically after a pre-determined amount of time.

Figure 6:
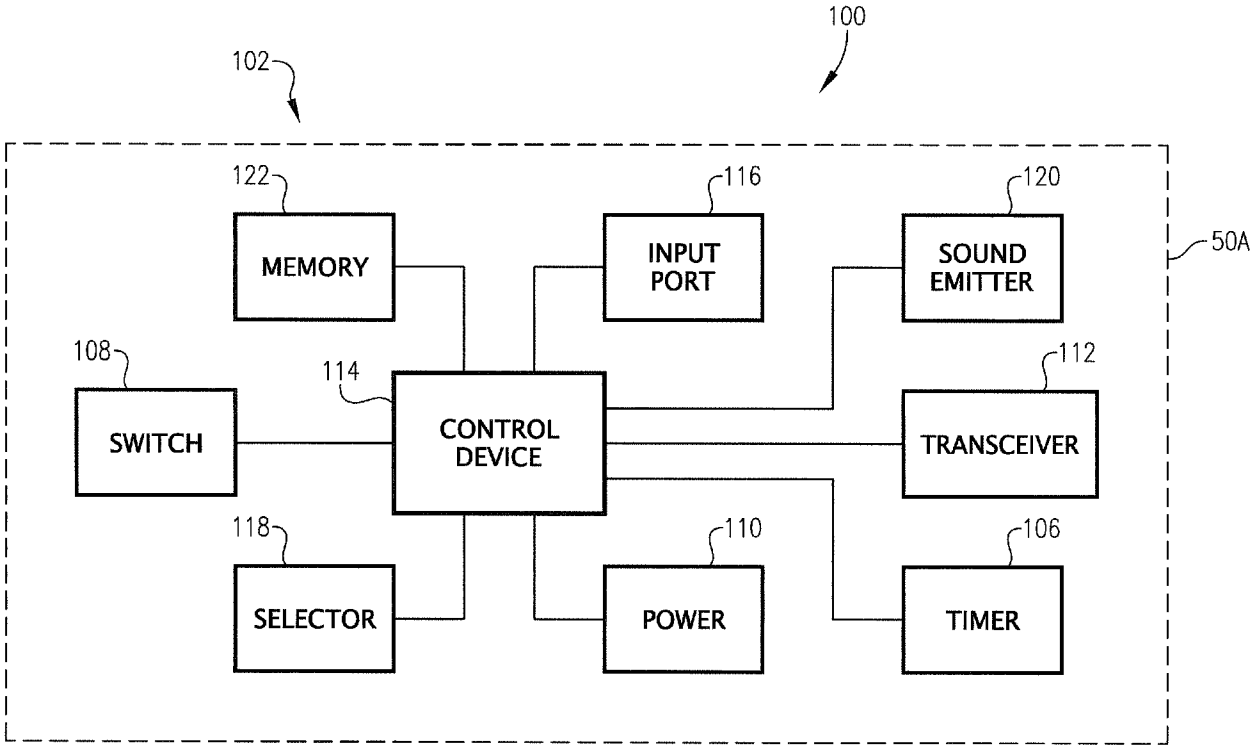
FIG. 6 is a block diagram of the primary components of a base unit constructed in accordance with another embodiment of the invention.
Figure 8:
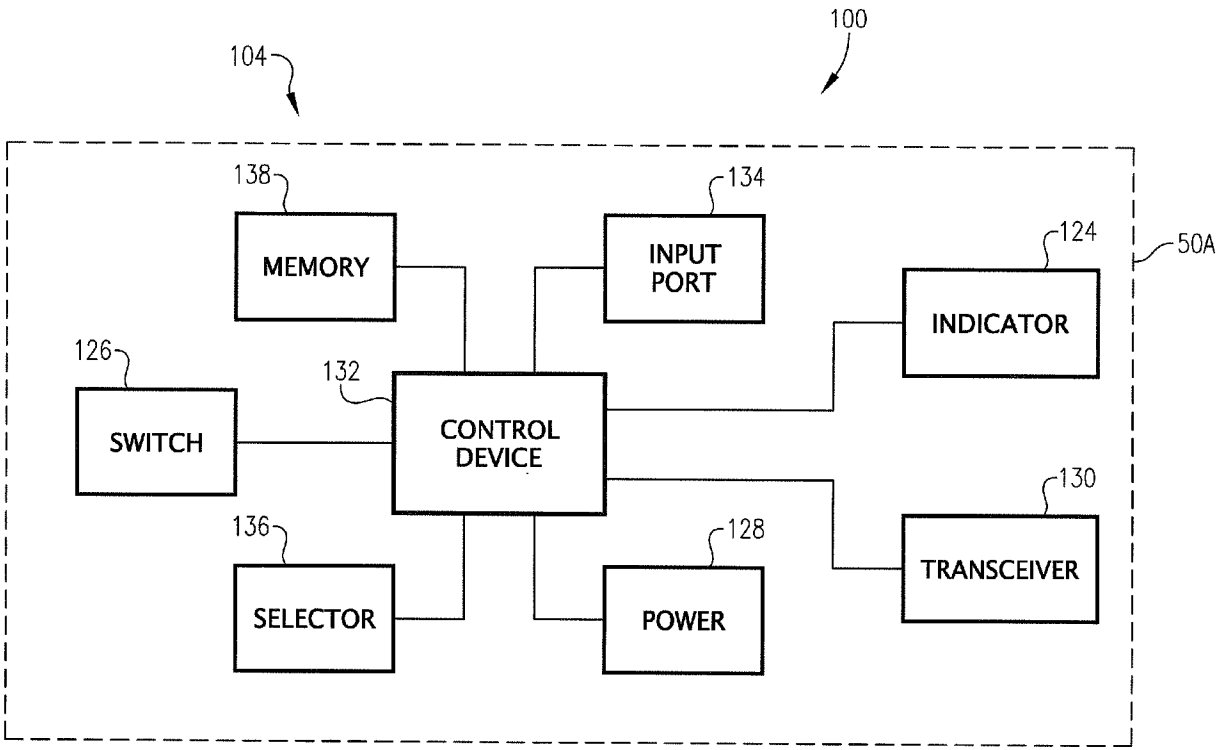
FIG. 8 is a block diagram of the primary components of a remote unit constructed in accordance with another embodiment of the invention.

An interactive timing system 100 constructed in accordance with another embodiment of the invention is illustrated in FIGS. 6 and 8. In this embodiment, the interactive timing system 100 comprises a base unit 102 and a plurality of remote units 104A-E that communicate with one another to permit a user to create a variety of different obstacle courses or similar challenges as described below.

The base unit 102 comprises a timer 106, a switch 108, and a power source 110 that are essentially identical to the same named components described above. In addition, the base unit 102 may further comprise a transceiver 112, a control device 114, an input port 116, a selector switch 118, and a sound-emitting device 120.

The transceiver 112 transmits an activation signal to the remote units when the base unit's switch 108 is pressed or when instructed by the control device 114 as described in more detail below. The transceiver may use any wireless transmission technology such as radio frequency (RF), Bluetooth, infrared, Wi-Fi, etc.

The control device 114 is configured to instruct the timer 106 to countdown a user-selected amount of time and to instruct each of the remote units to activate its indicator in a particular sequence when the base unit switch 108 is pressed. The control device 114 may include any number and type of processors, controllers, or other processing systems and may include resident or external memory for storing audio files and other information accessed and/or generated by the sound module.

The control device 114 may implement one or more computer programs which control the timer 106 and the remote units 104 as described herein. The computer programs may comprise ordered listings of executable instructions for implementing logical functions in the control device. The computer programs can be embodied in any computer-readable medium 122 for use by or in connection with the control device or any other device that can fetch and execute the instructions. As used herein, a "computer-readable medium" can be any means that can contain, store, communicate, propagate or transport computer programs. The computer-readable medium can be, for example, but not limited to, an electronic, magnetic, optical, electro-magnetic, infrared, or semi-conductor system, apparatus, device, or propagation medium. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

The input port 116 may be provided for receiving audio signals from an MP3 player, radio, TV, computer or other external audio source. The base unit transmitter 112 may then transmit the signals for reproduction by one or more of the remote units. Alternatively, the base unit or one or more of the remote units may receive audio signals wirelessly via a Bluetooth connection or other wireless connection. In yet another embodiment, the base unit or one or more of the remote units may include an internal or integral MP3 player, radio, or other audio source.

The selector 118 may be a keypad, switch, button, etc. that permits a user to provide an input instruction to the control device. For example, the selector 118 may be operated by a user to select a countdown time period for the timer 106, the order in which the remote units 104 are activated, or any other functions described herein.

The sound-emitting device 120 may be a speaker, horn, buzzer, or any other such device and may emit sounds when the switch 108 is pressed and/or when the switches of the remote units are pressed.

As illustrated in FIG. 8, each remote unit 104 of the interactive timing system 100 comprises an indicator 124, a switch 126, and a power source 128 that are essentially identical to the same named components described above. In addition, each remote unit may further comprise a transceiver 130, a control device 132, an input port 134, and a selector switch 136.

The transceiver 130 receives the activation signals sent by the base unit 102 when the base unit's switch 108 is pressed and controls operation of its indicator 124 in response to the signals. The transceiver 130 may use any wireless transmission technology such as radio frequency (RF), Bluetooth, infrared, Wi-Fi, etc.

The control device 132 is configured to instruct its indicator 124 to activate in a particular sequence and to provide a confirmation signal to the base unit 102 and possibly even the other remote units. The control device 132 may include any number and type of processors, controllers, or other processing systems and may include resident or external memory for storing audio files and other information accessed and/or generated by the sound module.

The control device may implement one or more computer programs which control its indicator 124 and transceiver 130. The computer programs may comprise ordered listings of executable instructions for implementing logical functions in the control device. The computer programs can be embodied in any computer-readable medium 138 for use by or in connection with the control device or any other device that can fetch and execute the instructions. As used herein, a "computer-readable medium" can be any means that can contain, store, communicate, propagate or transport computer programs. The computer-readable medium can be, for example, but not limited to, an electronic, magnetic, optical, electro-magnetic, infrared, or semi-conductor system, apparatus, device, or propagation medium. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

Each remote unit 104 may include its own control device 132, or only one remote unit may have a control device for receiving inputs from all the switches of all the remote units and communicating with the base unit 102. If each remote unit includes a separate control device, the control devices may communicate with each other over a wired or wireless communication channel to synchronize operation of the various remote units.

The input port 134 may be provided for receiving audio signals from an MP3 player, radio, TV, computer or other external audio source for reproduction by one or more of the sound-emitting devices. Each remote unit may have such an input port, or only one may have one for delivering signals to all of the remote units. Alternatively, one or more of the remote units may receive audio signals wirelessly via a Bluetooth connection or other wireless connection. In yet another embodiment, one or more of the remote units may include an internal or integral MP3 player, radio, or other audio source.

The selector 136 may be any switch, button, etc. that permits a user to provide an input instruction to the control device. For example, the memory 138 may store a plurality of audio files, and the selector switch may be operated by a user to select which of the audio files is reproduced by the sound-emitting device of that remote unit when its switch is activated.

The interactive timing system 100 may operate as follows. A user may first use the selector 118 or other input on the base unit 102 to create a custom control program. In one embodiment, the user may select the order in which the remote units 104 are activated and the time period in which a child must press the switches of all the remotes. For example, as illustrated in FIG. 2, the user may provide inputs that designate the remote unit 104A as the first to be activated, the remote unit 104B as the second to be activated, the remote unit 104C as the third to be activated, the remote unit 104D as the fourth to be activated, and the remote unit 104E as the fifth to be activated. The user may then enter a time period in which all the remote units must be activated (eg. 5 minutes).

A child may then press the switch 108 of the base unit 102 to start the timer. The base unit 102 then sends an activation signal to the first designated remote unit to trigger its indicator. The child then runs to the first remote unit and presses its switch. This turns off or silences the first remote unit's indicator and triggers the base unit or the first remote unit to send an activation signal to the second designated remote unit to trigger its indicator. The child then runs from the first remote unit to the second remote unit and presses the switch of the second remote unit to turn off or silence its indicator. This process is then repeated until all of the remote units have been activated and turned off by the child. After the last remote unit is reached by the child and turned off or silenced, an indicator on the base unit may illuminate or make sounds to prompt the child to return to the base unit. When the child presses the switch on the base unit, the timer indicates the time it took for the child to complete the obstacle course. At any time, a user may program the control device with a different sequence of remote units and/or different countdown time periods. A user may even designate that certain or all of the remote units be activated more than one time. Thus, the interactive timer system 100 may be used to create an infinite number of obstacle courses or other challenges.

In other embodiments of the invention, the base unit 102 and/or one or more of the remote units 104A-E may also comprise a motion detector. The motion detector may be any device or components capable of detecting movement of children as they interact with the play systems. For example, the motion detector may incorporate one or more ball switches, accelerometers, levels, gyroscopes, or strain gauges for detecting motion of the accessories or stations, or one or more ultraviolet, ultrasonic, or other wave type sensors for detecting motion of children while interacting with the accessories or stations. The motion detectors may be used instead of the switches 108, 126 to show that a child has completed each station in the obstacle course.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. An interactive timing system for use with a play system, the timing system comprising:

a base unit configured for mounting at a base location on or near the play system, the base unit comprising— a timer; and a manually-activated input for activating the timer; and a plurality of remote units each configured for mounting at a location on or near the play system remote from the base unit, each remote unit comprising— an indicator; and a manually-activated input for controlling the indicator.

2. The interactive timing system as set forth in claim 1, wherein the base unit further comprises a transmitter for transmitting an activation signal to the remote units when the manually-activated input of the base unit is activated.

3. The interactive timing system as set forth in claim 2, wherein each of the remote units further comprises a receiver for receiving the activation signal and for controlling its indicator in response thereto.

4. The interactive timing system as set forth in claim 3, wherein the activation signal activates the indicators of the remote units and the manually-activated input of each remote unit is configured to deactivate its indicator when operated.

5. The interactive timing system as set forth in claim 3, wherein the base unit further comprises a control device configured to instruct the timer to countdown a specified amount of time and to instruct each of the remote units to activate its indicator in a particular sequence when the manually-activated input of the base unit is operated.

6. The interactive timing system as set forth in claim 5, wherein each of the remote units further comprises a control device configured to send a confirmation signal to the control device of the base unit when the manually-activated input of the remote unit is operated.

7. The interactive timing system as set forth in claim 1, wherein the manually-activated input of the base unit is a push-button switch and the manually-activated input of each of the remote units is a push-button switch.

8. The interactive timing system as set forth in claim 1, wherein the indicator of each remote unit is a light or a sound-emitting device.

9. The interactive timing system as set forth in claim 1, wherein the timer of the base unit is a countdown timer.

10. The interactive timing system as set forth in claim 1, wherein each of the base unit and the remote units further comprises a sound-emitting device, memory for storing a plurality of audio files, and a selector switch for permitting a user to select which of the audio files is reproduced by its sound-emitting device.

11. The interactive timing system as set forth in claim 10, wherein each of the base unit and the remote units further comprises an input for receiving audio signals from an external audio source for reproduction by its sound-emitting device.

12. The interactive timing system as set forth in claim 11, wherein the sound emitted by each of the remote units is unique and different from the sounds emitted by other remote units.

13. The interactive timing system as set forth in claim 1, wherein the play system is a swing set, obstacle course, or combined swing set and obstacle course.

14. An interactive timing system for use with a play system, the timing system comprising:

a base unit configured for mounting at a base location on or near the play system, the base unit comprising— a timer;

a switch for activating the timer;

a transmitter for transmitting an activation signal; and a plurality of remote units each configured for mounting at a location on or near the play system remote from the base unit, each remote unit comprising— an indicator;

a receiver for receiving the activation signal from the base unit and activating the indicator in response thereto; and a switch for turning off the indicator.

15. The interactive timing system as set forth in claim 14, wherein the indicator of each remote unit is a light or a sound-emitting device.

16. The interactive timing system as set forth in claim 14, wherein the timer of the base unit is a countdown timer.

17. The interactive timing system as set forth in claim 14, wherein the base unit further comprises a control device configured to instruct the timer to countdown a specified amount of time and to instruct each of the remote units to activate its indicator in a particular sequence when the switch of the base unit is operated.

18. The interactive timing system as set forth in claim 17, wherein each of the remote units further comprises a control device configured to send a confirmation signal to the control device of the base unit when the switch of the remote unit is operated.

19. The interactive timing system as set forth in claim 14, wherein each of the base unit and the remote units further comprises a sound-emitting device, memory for storing a plurality of audio files, and a selector switch for permitting a user to select which of the audio files is reproduced by its sound-emitting device.

20. The interactive timing system as set forth in claim 19, wherein each of the base unit and the remote units further comprises an input for receiving audio signals from an external audio source for reproduction by its sound-emitting device.

* * * * *